US007601199B2

(12) United States Patent
Shen et al.

(10) Patent No.: US 7,601,199 B2
(45) Date of Patent: Oct. 13, 2009

(54) NI AND NI/NIO CORE-SHELL NANOPARTICLES

(75) Inventors: Wenjie Shen, Liaoning (CN); Yong Li, Liaoning (CN); Mei Cai, Bloomfield Hills, MI (US); Jerry D. Rogers, Rochester Hills, MI (US)

(73) Assignees: GM Global Technology Operations, Inc., Detroit, MI (US); Dalian Institute of Chemical Physics, Chinese Academy of Sciences, Dalian (CN)

( * ) Notice: Subject to any disclaimer, the term of this patent is extended or adjusted under 35 U.S.C. 154(b) by 501 days.

(21) Appl. No.: 11/335,211

(22) Filed: Jan. 19, 2006

(65) Prior Publication Data

US 2007/0166455 A1 Jul. 19, 2007

(51) Int. Cl.
*B22F 9/16* (2006.01)
*C01G 53/04* (2006.01)

(52) U.S. Cl. ..... 75/365; 75/374; 423/594.19

(58) Field of Classification Search ..... 423/594.19; 75/365, 374

See application file for complete search history.

(56) References Cited

U.S. PATENT DOCUMENTS 4,539,041 A * 9/1985 Figlarz et al. ..... 420/435
5,512,094 A 4/1996 Linton

FOREIGN PATENT DOCUMENTS

| | | |
|---|---|---|
| CN | 1381328 | * 11/2002 |
| CN | 1415621 | * 5/2003 |
| CN | 1631589 | * 6/2005 |

OTHER PUBLICATIONS

Korean Office Action; translation and original document.

* cited by examiner

*Primary Examiner*—Wayne Langel
*Assistant Examiner*—James Fiorito
(74) *Attorney, Agent, or Firm*—Reising Ethington P.C.

(57) ABSTRACT

Glycerol is used as a solvent medium for the precipitation of a complex of nickel and glycerol material. The precipitate is separated from the liquid solvent and dried and calcined in air to produce small (nanometer size) particles characterized by a nickel core encased in a nickel oxide shell. The proportions of nickel core and nickel oxide shell can be controlled by management of the time and temperature of heating in air. Prolonged heating in air can produce nickel oxide particles, or calcining of the precipitate in nitrogen produces nickel particles.

11 Claims, 4 Drawing Sheets

NI AND NI/NIO CORE-SHELL NANOPARTICLES

TECHNICAL FIELD

This invention pertains to nanometer size, core/shell type particles of nickel/nickel oxide. The invention also pertains to nanometer size particles of nickel or nickel oxide. The invention also pertains to a method of making such particles.

BACKGROUND OF THE INVENTION

Core-shell particles have a core of one material and an enclosing shell of another material. The preparation of core-shell particles, especially particles of nanometer scale size, is of increasing importance. For instance, metal/metal oxide core-shell nanoparticles, such as $Sn/SnO_2$, Zn/ZnO and $Cu/Cu_2O$, where the core and the shell originate from the same material, have shown some potential applications in catalytic reactions, gas sensors, and magnetic materials. Particles of these particular metal elements are readily obtained by chemical reduction of their cations from a suitable solvent. The small metal particles were separated from the liquid and subjected to controlled oxidation of the outer layer with air or oxygen to form the metal/metal oxide core shell materials.

Nickel and nickel oxide compositions are important ferromagnetic materials and they are widely used as catalysts in hydrocarbon conversion reactions. However, the synthesis of Ni and Ni/NiO core-shell materials is more of a problem, mainly due to the difficulty in reducing $Ni^{2+}$ into metallic nickel through a liquid chemical process using common reducing agents. Currently, nanometer size nickel particles are prepared using one of two methods: (1) physical processing, such as pulsed laser ablation, electron-gun evaporation, electrochemical deposition, or metal-organic chemical vapor deposition, or (2) chemical syntheses, such as surfactant-associated micro emulsion techniques or hydrothermal techniques. The chemical synthesis methods can only be practiced using very dilute nickel solutions ($Ni^{2+}$ concentrations of 2.5 to 45 mmol/L) in the presence of strong reducing agents.

It would be very useful to have a more efficient method of preparing nanometer sized, Ni/NiO core/shell type materials.

SUMMARY OF THE INVENTION

This invention provides a method for preparing pure Ni particles, or NiO particles, or Ni/NiO core-shell particles using glycerol as the mediator. The respective particles may be produced with diameters or largest dimensions in a range of, for example, five to five hundred nanometers. For example, particle sizes ranging from about twelve nanometers (nm) about thirty nanometers have been obtained. This process allows precise control of the structure of final product through some easily adjustable processing parameters.

In accordance with a preferred embodiment of the invention, a suitable nickel precursor compound is dissolved in glycerol. The glycerol may contain water or other miscible liquid provided a suitable amount of glycerol is present for the formation of a nickel-glycerol complex as will be described. Suitable precursor compounds include common acid salts of Ni (II) such as nickel acetate, $Ni(OAc)_2.4H_2O$, or nickel nitrate, $Ni(NO_3)_2.6H_2O$. The use of a hydrated precursor, for example, is suitable because the water is miscible with the glycerol solvent medium. When a glycerol solution of the nickel precursor compound is obtained, the nickel is precipitated as a calcinable nickel-glycerol compound by the controlled addition of a basic salt solution. The basic material may, for example, be sodium carbonate dissolved in water.

The slow addition of a 0.2 M $Na_2CO_3$ aqueous solution to the Ni-containing glycerol solution produces a gel-like precipitate, apparently of a nickel-glycerol complex material. Preferably, the precipitate-containing, glycerol medium is aged at above ambient temperature, for example at 80° C. for 1 hour. The gel-like precipitate is then filtered and washed with distilled water. The cleaned precipitate is dried, suitably overnight at 100° C., and the dried product is then ready for heating (calcining) in an atmosphere selected for the conversion of the metal-organic precipitate to pure nickel particles, nickel oxide particles, or Ni/NiO core shell particles. The use of glycerol as a solvent or mediator for the nickel precursor leads to the formation of a nickel-glycerol containing precipitate that is calcinable to nanometer size particles of the desired nickel species.

The formation of Ni nanoparticles and NiO/Ni core-shell nanoparticles and their structural features are strongly dependent on the calcination parameters, such as temperature and atmosphere. For example, when the precipitate is calcined in nitrogen, only metal Ni nanoparticles are generated with a typical face-centered cubic (FCC) structure. However, when the calcination is performed in air, metallic Ni coated with nickel oxide is formed with a FCC structure.

Transmission electron microscopic images show the formation of uniform NiO/Ni nanoparticles with the edges and crystalline structures of a nickel oxide shell after calcination at 400° C. in air, but particles calcined at 400° C. under a nitrogen atmosphere exhibit fully reduced Ni particles. Particle size calculation based on XRD patterns has indicated that the ratio between nickel and nickel oxide in the Ni/NiO core-shell nanoparticles greatly depends on the temperature and the period of calcination. Calcination at suitable temperatures in air leads to the formation of particles with a NiO shell that completely isolates each individual Ni core. By controlling calcination parameters of temperature and time, particles with a stabilized nickel core surrounded by a nickel oxide shell are obtained. However, particles that have been fully oxidized to NiO can be obtained at high calcining temperatures, for example of the order of 600° C.

Thus, pure nickel particles, or pure nickel oxide particles, or core/shell type particles of nickel and nickel oxide, respectively, each of nanometer size, can be prepared after using glycerol as a dissolution and precipitation medium for a suitable nickel precursor compound. These small crystalline particles are useful in catalyst applications, sensor applications, and as magnetic materials.

Other objects and advantages of the invention will become apparent from a detailed description of preferred embodiments, which follows.

DESCRIPTION OF PREFERRED EMBODIMENTS

In this method a suitable nickel (II) salt is dissolved in glycerol (also known as 1, 2, 3-propanetriol or glycerin). It is preferred to use undiluted glycerol, but it is recognized that glycerol has a strong affinity for water and the glycerol based-solvent may contain some water or other miscible material. And, as will be seen, water may be added to the glycerol by a hydrated nickel compound or by the subsequent addition of a base to precipitate nickel.

A nickel-glycerol precipitate is formed from a glycerol medium. The precipitate is dried and then calcined in an atmosphere chosen to form nanometer sized nickel particles or nanometer sized nickel-nickel oxide core-shell materials, or nanometer sized nickel oxide particles. Pure Ni and Ni/NiO core-shell nanoparticles have been produced by the embodiments described below with particle sizes ranging from about 10 nm to about 30 nm. This process allows control of the core-shell structure of the final product through some easily adjustable processing parameters.

Experimental

A solution containing 0.05 mol of nickel precursors (nickel acetate, $Ni(OAc)_2.4H_2O$, or nickel nitrate, $Ni(NO_3)_2.6H_2O$) and 300 mL of glycerol was gradually heated to 80° C. with stirring and maintained at this temperature for 30 min. Then, 500 mL of 0.2 M $Na_2CO_3$ aqueous solution was slowly added into the Ni-containing glycerol solution. The mixture was then aged at 80° C. for one hour, producing a gel-like precipitate that was filtered and washed with distilled water. The aging step appears to yield a more uniform and processable precipitate.

After drying the precipitate overnight at 100° C., the samples of the solid product were calcined at several temperatures in different environments. Depending on the calcination temperature and the composition of the calcining atmosphere (either nitrogen or air), the resulting Ni and/or NiO/Ni core-shell nanoparticles were formed with different structures.

Chemical and physical properties of the samples were characterized by x-ray diffraction (XRD), thermo-gravimetric (TG) and differential thermal analysis (DTA), and transmission electron microscopy (TEM). Mass spectroscopy was used to determine the species released when the samples were heat-treated.

Results and Discussion

Figure 1:
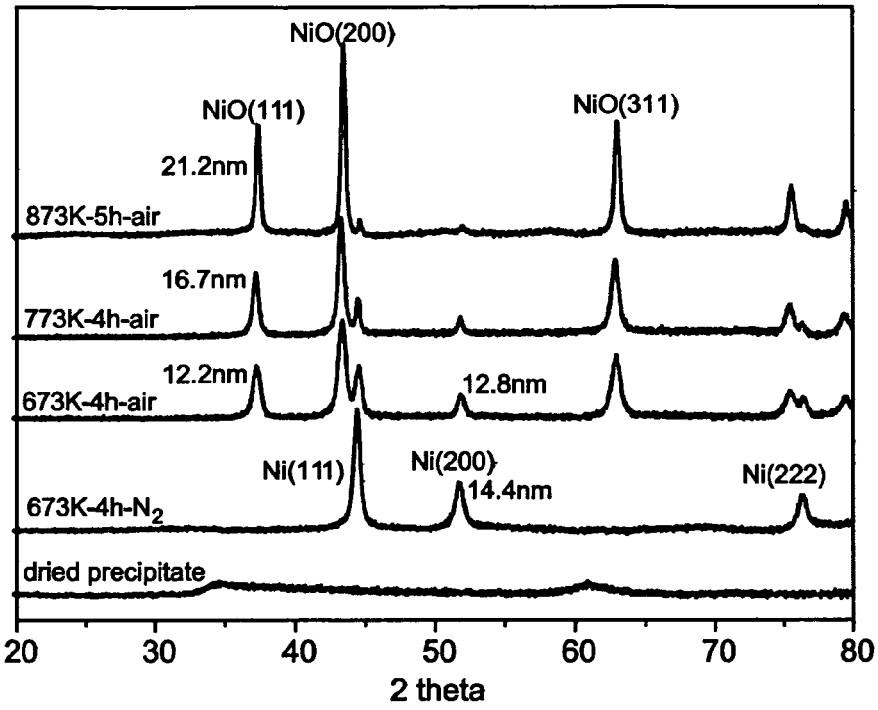
FIG. 1 is a composite graph of five X-ray diffraction patterns of a dried nickel-glycerol precipitate, and of calcined samples of the precipitate.

The XRD pattern (over the 2θ diffraction angles) of the gel-like precipitate (lowest diffraction line in FIG. 1) showed no distinct diffraction peaks. This data suggests the presence of an amorphous nickel complex. FIG. 1 also shows diffraction patterns for the particulate products of four nickel-glycerol precipitate samples that were calcined in nitrogen or air. These patterns, clearly indicating crystalline products, are discussed below in this specification.

Figure 2A:
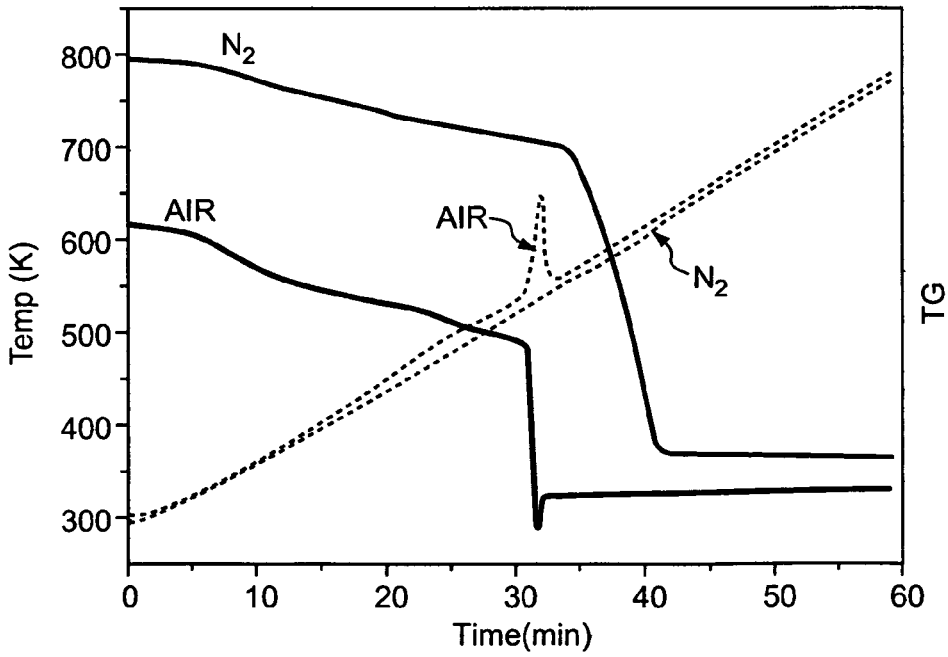
FIG. 2A is a graph of thermo gravimetric (TG) measurements over a period of 60 minutes and at temperatures increasing from about room temperature (298K) to 773K of gel-like nickel-glycerol precipitates calcined under atmospheres of $N_2$ and air, as labeled on the graph. The dashed lines represent the temperatures of the samples in K measured during concurrent differential thermal analyses, and the solid lines represent the proportional weight changes of the samples as they were heated.

FIG. 2A presents thermogravimetric (TG) data for a nickel-glycerol sample heated in a nitrogen atmosphere from 298K to 773K over a period of about 60 minutes. In a separate test a like nickel-glycerol sample was calcined in air over the same temperature range and period of time. DTA testing of each sample was performed during the TG testing by comparing their temperatures with the temperature of an inert reference material positioned nearby in the furnace used for the thermal analyses. The DTA data is presented in FIG. 2B. Decomposition products were released by the respective samples as they were heated. Mass spectrometer data of the decomposition products of the nitrogen-calcined sample is presented in FIG. 2C.

In FIG. 2A, the labeled dashed lines record the temperatures of the samples heated in air and nitrogen, and the labeled solid lines record relative changes in sample weight as the respective samples were heated over a period of about sixty minutes. The TG data for the two samples are presented on the same graph with the nitrogen-calcined sample data presented above the air-calcined sample data. The relative vertical change in the position of the respective curves, referring to the vertical TG axis at the right side of the Figure, reflects their relative change in weight.

The TG data shows that both the nitrogen-calcined sample and the air-calcined sample lost weight progressively, apparently due to water loss. Then at 537K (about 264° C.) the air-calcined sample experienced an abrupt and proportionally large weight loss as the glycerol complex was decomposed with the release of carbon dioxide and water. It is interesting to note that the weight loss was followed by a significant weight increase during the TG process (see FIG. 2A). This exothermic peak could imply that the newly formed nickel nanoparticles (from the decomposition of the nickel-glycerol complex) were undergoing re-oxidation in air, leading to the formation of NiO/Ni core-shell nanoparticles.

As further shown in FIG. 2A, the nitrogen-calcined sample experienced a significant, but less abrupt, weigh loss starting at about 548K. This marked the beginning of its decomposition with a resulting residue of nanometer size nickel particles. The MS data of FIG. 2C shows the release of hydrogen, water, carbon monoxide, and carbon dioxide from the nitrogen-calcined nickel-glycerol gel at temperatures following the onset of its weight loss as shown in FIG. 2A.

Figure 2B:
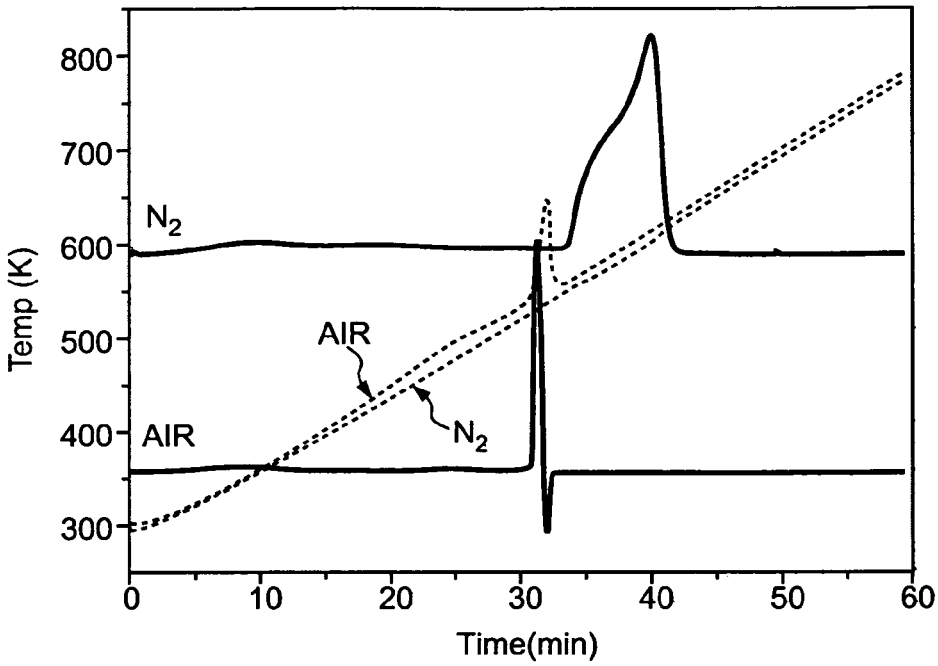
FIG. 2B is a graph of differential thermal analyses (DTA) over a period of 60 minutes and at temperatures increasing from about room temperature (298K) to 773K of gel-like nickel-glycerol precipitates calcined under atmospheres of $N_2$ and air, as labeled on the graph. The dashed lines represent the temperatures of the samples in K, and vertical changes in the generally horizontal solid lines represent temperature differences of the samples as they were heated as compared to temperatures of inert reference materials.
Figure 2C:
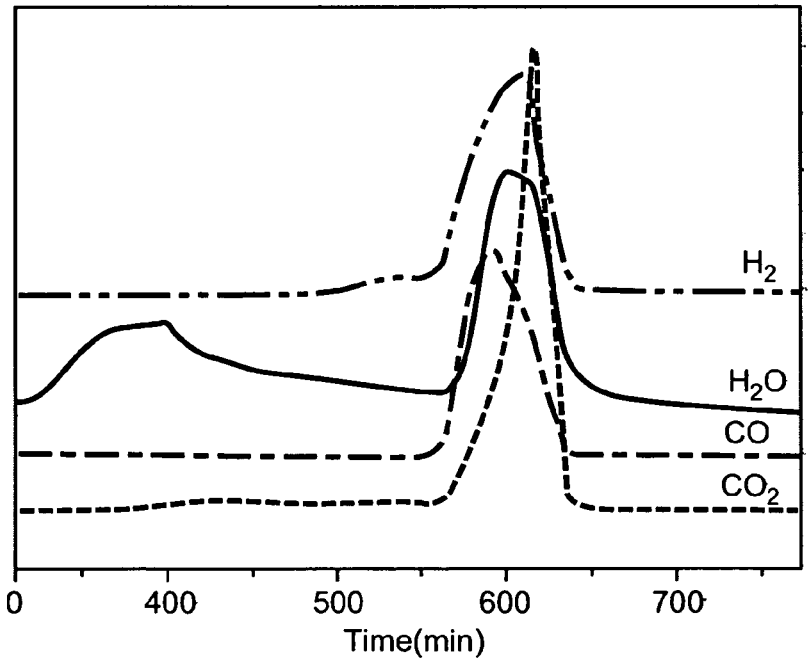
FIG. 2C is a graph of mass spectroscopy data showing release of decomposition products (hydrogen, water, carbon monoxide, and carbon dioxide) at increasing temperatures from a gel-like nickel-glycerol precipitate as it was calcined under nitrogen.

The DTA data presented in FIG. 2B shows the increases in temperature of the respective decomposing calcined samples as compared to their inert reference counterparts. The air-calcined sample showed an abrupt temperature increase (compared to its reference material) as it decomposed followed by a temperature decrease as it was oxidized. The nitrogen-calcined sample experienced a less abrupt temperature increase as it decomposed, but it, of course, experienced no oxidation.

It was found that the formation of Ni particles and NiO/Ni core-shell nanoparticles and their structural features were strongly dependent on the calcination parameters, particularly temperature and atmosphere composition. As shown in FIG. 1 XRD patterns, when the nickel-glycerol precipitate was calcined in nitrogen for four hours at 673K (about 400° C.), only metal Ni nanoparticles were generated with a typical face-centered cubic (FCC) structure. The initial heating decomposed and removed the glycerol portion of the precipitate to leave substantially pure nickel particles. This pattern is the second pattern raised above the horizontal axis of FIG. 1 and reveals a Ni (111) diffraction maximum (peak), a Ni (200) peak and a Ni (222) peak. The particle size of this nickel particle sample, as determined from the XRD pattern was 14.4 nm.

When the calcination was performed in air, metallic Ni coated with nickel oxide was formed with FCC core and shell structures. Three nickel-glycerol precipitate samples were calcined in air at 673K for four hours, 773K for four hours, and 873K for five hours, respectively. Their diffraction patterns are displayed at the labeled third, fourth and fifth levels above the baseline in FIG. 1. As the air calcination temperatures and time was increased, the particle sizes increased from 12.2 nm to 16.7 nm to 21.2 nm, respectively, as determined from the diffraction data. The increase in particle size is attributed in part to the increased proportion of NiO to Ni in the core-shell particles as the calcination-in-air temperature was increased. The largest core-shell particles produced from the nickel-glycerol precipitate were oxidized at the highest temperature (about 600° C.) in this series of examples, and for the longest duration, five hours.

Figure 3A:
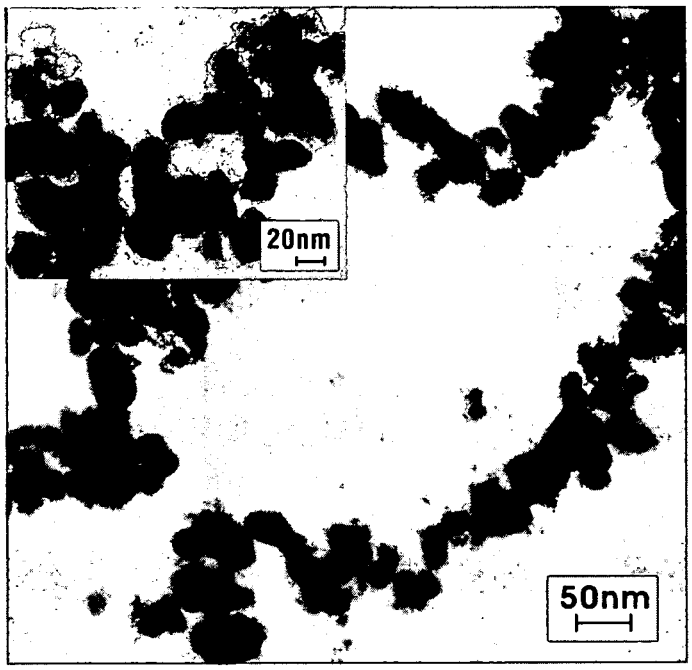
FIG. 3A is a TEM image of Ni nanoparticles produced by calcination of a nickel-glycerol precipitate in nitrogen at 673K.
Figure 3B:
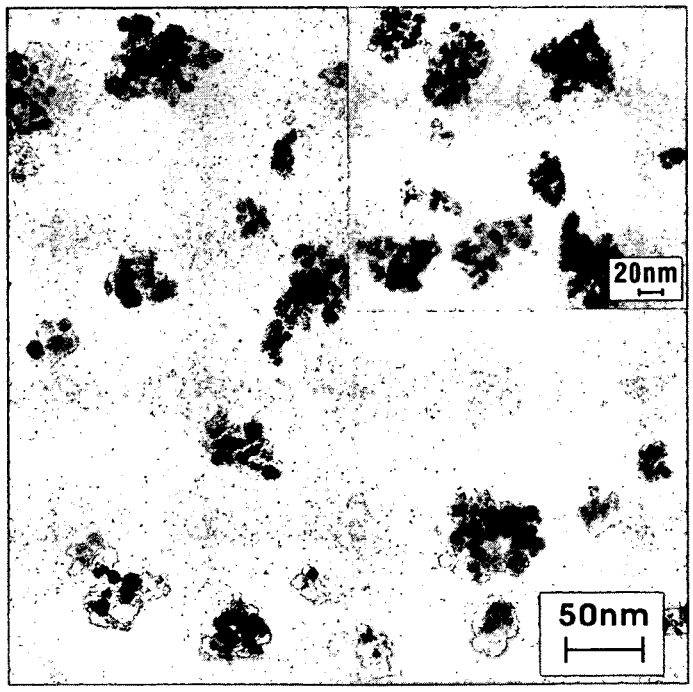
FIG. 3B is a TEM image of Ni/NiO core-shell nanoparticles produced by calcination of a nickel-glycerol precipitate in air at 673K.

Transmission electron microscopic images (FIGS. 3A and 3B) showed the formation of uniform NiO/Ni nanoparticles (FIG. 3B) with the edges and crystalline structures of nickel oxide shell after calcination at 673K (400° C.) in air. But particles calcined at 673K (400° C.) under a nitrogen atmosphere exhibited fully reduced Ni particles (FIG. 3A). Both the nickel particles and the nickel-nickel oxide core-shell particles are clearly less than fifty nanometers in largest dimension. The sizes of the primary nickel particles seen in FIG. 3A are in the range of 30 to 40 nm. The sizes of the primary nickel-nickel oxide core-shell particles seen in FIG. 3B are in the range of 10-20 nm.

As suggested above, particle size calculation based on XRD patterns (FIG. 1) indicated that the ratio between nickel and nickel oxide in the Ni/NiO core-shell nanoparticles greatly depend on the temperature and the period of calcination. Initial calcination of the nickel-glycerol precipitate in air decomposes the material and removes the organic portion. Continued heating in air causes the formation and growth of a NiO shell that isolates each individual Ni core; this led to a stabilized metallic Ni core that was unaffected by oxygen in the air at ambient temperatures and relatively low temperatures. But further heating of Ni—NiO materials at calcining temperatures in air gradually increased the proportion of the nickel oxide shell at the expense of the nickel core material. The particle size increases, still in the nanometer range, due apparently to the larger size of nickel oxide molecules.

Prolonged calcination in air (for example at 600° C.) gradually converts all nickel in the core portion of each particle to nickel oxide and substantially pure nickel oxide articles of nanometer size are obtained.

In the case of the Ni and NiO/Ni core shell nanometer size materials prepared here, it is believed that the role of glycerol can be explained with reference to likely reaction steps stated below in reactions (1) to (4).

The solvated nickel ions ($Ni^{2+}$) initially interact with the glycerol solvent medium to form a nickel-glycerol complex as indicated in reaction (1). The Ni-glycerol complex is transformed into a gel-like precipitate, probably Ni $(OH)_x(CO_3)_y(CHO)_z$, after the addition of a basic solution, in this example—sodium carbonate aqueous solution (Reaction 2). During calcination, the organic ligands start to decompose into $H_2$, $H_2O$, CO, and $CO_2$, while the $Ni^{2+}$ is simultaneously reduced to metallic nickel particles (reaction 3). However, the outer surface of the Ni nanoparticles can be oxidized into NiO shell in the presence of air, resulting in the formation of NiO/Ni core shell nanoparticles (reaction 4).

$$Ni^{2+}+C_3H_8O_3+2OH^-\rightarrow Ni(C_3H_6O_3)+2H_2O \quad (1)$$

$$Ni(C_3H_6O_3)+OH^-+CO_3^{2-}\rightarrow Ni(OH)_x(CO_3)_y(CHO)_z \quad (2)$$

$$Ni(OH)_x(CO_3)_y(CHO)_z\rightarrow Ni+CO_2+H_2O+CO+H_2 \quad (3)$$

$$2Ni+O_2\rightarrow 2NiO \quad (4)$$

Figure 4:
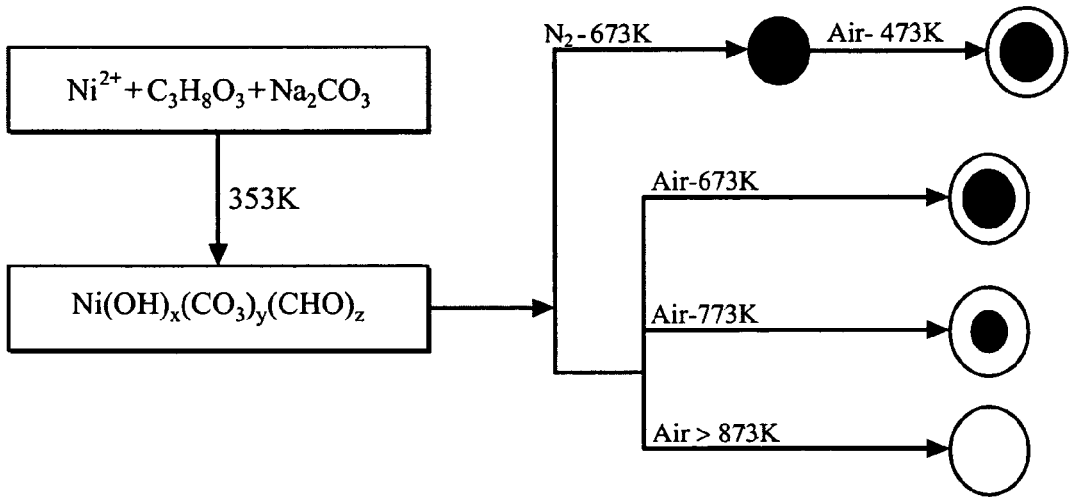
FIG. 4 is a flow diagram of the synthesis procedure for nickel, nickel oxide, and nickel/nickel oxide core/shell nanoparticles.

The processing of the nickel-containing gel precipitate into different nickel and nickel/nickel oxide core/shell structures under the various calcining conditions described above is illustrated and summarized in the flow diagram of FIG. 4. The interaction of nickel ions, glycerol, and sodium carbonate (upper box, left side of FIG. 4) at 353K produces the calcinable precipitate $Ni(OH)_x(CO_3)_y(CHO)_z$ indicated in the lower box of FIG. 4.

As described above, different samples of the dried nickel-glycerol precipitate were heated, either in nitrogen or in air, at different temperatures. The labeled arrow streams from the lower box lead to schematic representations of particulate nickel (black filled circles) or nickel oxide shells or particles (clear annular rings or circles).

As indicated by the upper-labeled arrow stream in FIG. 4, one nickel-glycerol precipitate sample was heated at 673 K (400° C.). It was heated for four hours in a nitrogen atmosphere and nickel particles were produced as indicated by the black filled circle. The XRD pattern of FIG. 1 indicated that the material was substantially pure nickel with a particle size of about 14.4 nm. A portion of this particulate nickel material was further heated in air at 473K to produce nanosize particles with a nickel core and nickel oxide shell as represented in FIG. 4 by the solid black circle core and the clear annular ring.

As further illustrated in FIG. 4, other samples of the dried nickel-glycerol precipitate were heated in air at progressively higher temperatures. One sample was heated in air for four hours at 673K and produced particles with a nickel core (illustrated as a dark sphere) with an enclosing spherical shell of nickel oxide (illustrated as an unfilled annulus). In the sample heated in air for four hours at 773K, the nickel spherical core is smaller and the nickel oxide spherical shell is thicker and larger. Finally, in the dried nickel-glycerol sample heated for five hours the material has been fully oxidized to nickel oxide (as illustrated by the unfilled circle). The illustrations of FIG. 4 complement the x-ray diffraction data presented in FIG. 1. Small particle size materials (from about 12 to 30 nanometers in diameter or largest particle diameter) were produced from the nickel-glycerol precipitates.

Thus, it is seen that by precipitation of a nickel-glycerol precipitate in accordance with the invention, it is possible to produce very small particles of substantially pure nickel, pure nickel oxide, or core-shell particles of nickel oxide shell and nickel core by heating of the precipitate in nitrogen or air. The proportion of the core size to shell size can be determined by the duration and temperature of calcination in air.

The practice of the invention has been illustrated by some preferred embodiments. But the scope of the invention is not intended to be limited by these illustrative examples.

The invention claimed is:

1. A method of making nanometer size particles of nickel or nickel oxide, or particles having a core of nickel enclosed in a shell of nickel oxide, the method comprising:

dissolving a nickel salt in a glycerol containing solvent;

precipitating a complex of nickel and glycerol from the solution, filtering the precipitate, washing the precipitate, and drying the precipitate; and thereafter heating the precipitate in an atmosphere and at a temperature and for a time selected to decompose the nickel-glycerol complex and to produce particles of nickel, or nickel oxide, or particles having a core of nickel enclosed in a shell of nickel oxide.

2. A method of making nanometer size particles as recited in claim 1 comprising heating the precipitate in nitrogen to produce particles consisting essentially of nickel.

3. A method of making nanometer size particles as recited in claim 1 comprising heating the precipitate in oxygen to produce particles consisting essentially of nickel oxide.

4. A method of making nanometer size particles as recited in claim 1 comprising heating the precipitate in oxygen to produce particles comprising a core of nickel and a nickel oxide shell enclosing the core.

5. A method of making nanometer size particles as recited in claim 1 further comprising heating the precipitate in nitrogen at a temperature of about 400° C. or higher to produce particles consisting essentially of nickel.

6. A method of making nanometer size particles as recited in claim 1 further comprising heating the precipitate in oxygen at a temperature of about 400° C. or higher to produce particles consisting essentially of nickel oxide.

7. A method of making nanometer size particles as recited in claim 1 further comprising heating the precipitate in oxygen at a temperature of about 400° C. or higher to produce particles comprising a core of nickel and a nickel oxide shell enclosing the core.

8. A method of making nanometer size particles as recited in claim 1 in which the nickel compound is nickel acetate or nickel nitrate.

9. A method of making nanometer size particles as recited in claim 1 in which nickel acetate or nickel nitrate is dissolved in glycerol and the nickel-glycerol complex is precipitated by the addition of a base.

10. A method of making nanometer size particles as recited in claim 1 in which nickel acetate or nickel nitrate is dissolved in glycerol and the nickel-glycerol complex is precipitated by the addition of aqueous sodium carbonate.

11. A method of making nanometer size particles as recited in claim 1 in which the particles produced have a particle size of about 10 nm to about 30 nm.

* * * * *

UNITED STATES PATENT AND TRADEMARK OFFICE

CERTIFICATE OF CORRECTION

PATENT NO. : 7,601,199 B2
APPLICATION NO. : 11/335211
DATED : October 13, 2009
INVENTOR(S) : Shen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 768 days.

Signed and Sealed this

Fifth Day of October, 2010

David J. Kappos

David J. Kappos
*Director of the United States Patent and Trademark Office*